US010501995B2

(12) United States Patent
Hird et al.

(10) Patent No.: US 10,501,995 B2
(45) Date of Patent: Dec. 10, 2019

(54) REAMER

(71) Applicant: SCHLUMBERGER TECHNOLOGY CORPORATION, Sugar Land, TX (US)

(72) Inventors: Jonathan Robert Hird, Cambridge (GB); Ashley Bernard Johnson, Cambridge (GB); Gokturk Tunc, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 191 days.

(21) Appl. No.: 15/328,055

(22) PCT Filed: Jul. 21, 2015

(86) PCT No.: PCT/US2015/041260
§ 371 (c)(1),
(2) Date: Jan. 22, 2017

(87) PCT Pub. No.: WO2016/014472
PCT Pub. Date: Jan. 28, 2016

(65) Prior Publication Data

US 2017/0211335 A1 Jul. 27, 2017

(30) Foreign Application Priority Data

Jul. 21, 2014 (GB) ..... 1412933.2

(51) Int. Cl.
*E21B 10/32* (2006.01)
*E21B 10/43* (2006.01)
(Continued)

(52) U.S. Cl.
CPC ..... *E21B 10/322* (2013.01); *E21B 10/43* (2013.01); *E21B 10/46* (2013.01); *E21B 10/567* (2013.01)

(58) Field of Classification Search
CPC ..... E21B 10/43; E21B 10/32; E21B 10/46; E21B 10/26; E21B 10/322; E21B 10/325
See application file for complete search history.

(56) References Cited

U.S. PATENT DOCUMENTS 4,431,065 A * 2/1984 Andrews ..... E21B 10/567 175/269
4,499,959 A * 2/1985 Grappendorf ..... E21B 47/18 175/405.1

(Continued)

FOREIGN PATENT DOCUMENTS

CA 2397110 A1 * 2/2003 ..... E21B 10/32
CA 2821495 A1 * 6/2012 ..... E21B 10/43

(Continued)

OTHER PUBLICATIONS

International Search Report and Written Opinion for related Application Serial No. PCT/US2014/068991, dated Mar. 25, 2015, 14 pages.

(Continued)

*Primary Examiner* — Jennifer H Gay

(57) ABSTRACT

A reaming tool for enlarging an underground borehole has a plurality of cutter assemblies distributed azimuthally around a longitudinal axis of the tool. First, second and possibly more cutter assemblies each have an axially extending length comprising supporting structure bearing a sequence of cutters which have hard surfaces facing in a direction of rotation of the tool and are distributed axially along the length. A plurality of the cutters on the second cutter assembly are at axial positions relative to the tool which are intermediate between axial positions of the cutters on the (Continued)

first cutter assembly. Cutters on further assemblies may also be at intermediate axial positions. Cutters in the overall plurality of sequences are positioned at radial distances from the tool axis which increase as axial distance from an end of the tool increases.

14 Claims, 11 Drawing Sheets

(51) Int. Cl.
*E21B 10/46* (2006.01)
*E21B 10/567* (2006.01)

(56) References Cited

U.S. PATENT DOCUMENTS 4,593,777 A 6/1986 Barr
4,710,074 A 12/1987 Springer
4,887,668 A 12/1989 Lynde et al.
5,070,952 A * 12/1991 Neff ..... E21B 10/322 166/55.7
5,238,075 A * 8/1993 Keith ..... E21B 10/55 175/431
5,341,888 A 8/1994 Deschutter
5,495,899 A * 3/1996 Pastusek ..... E21B 10/26 175/385
5,531,281 A * 7/1996 Murdock ..... E21B 10/43 175/431
5,967,247 A 10/1999 Pessier
6,397,958 B1 * 6/2002 Charles ..... E21B 10/16 175/391
6,732,817 B2 * 5/2004 Dewey ..... E21B 7/067
6,880,650 B2 4/2005 Hoffmaster et al.
6,920,923 B1 7/2005 Pietrobelli et al.
7,467,671 B2 12/2008 Savignat et al.
7,506,703 B2 * 3/2009 Campbell ..... E21B 10/322 175/263
7,571,782 B2 * 8/2009 Hall ..... E21B 10/43 175/425
7,726,415 B1 * 6/2010 Tipton ..... E21B 10/26 175/385
7,954,564 B2 * 6/2011 Makkar ..... E21B 10/322 175/263
7,963,348 B2 6/2011 Laird et al.
7,975,783 B2 7/2011 Fanuel et al.
8,162,081 B2 * 4/2012 Ballard ..... E21B 10/26 175/325.2
8,205,689 B2 6/2012 Radford
8,297,381 B2 10/2012 Radford et al.
8,517,124 B2 * 8/2013 Hareland ..... E21B 10/62 175/393
8,550,188 B2 10/2013 Makkar et al.
8,607,900 B1 * 12/2013 Smith ..... E21B 10/26 175/323
8,720,611 B2 * 5/2014 Chen ..... E21B 10/43 175/398
8,752,649 B2 * 6/2014 Isenhour ..... E21B 10/26 175/57
8,776,912 B2 * 7/2014 Makkar ..... E21B 7/28 175/263
8,905,126 B2 12/2014 Krieg et al.
9,051,793 B2 * 6/2015 Makkar ..... E21B 10/322
9,068,407 B2 6/2015 Radford et al.
9,074,434 B2 * 7/2015 Mensa-Wilmot ..... E21B 10/43
9,187,958 B2 * 11/2015 Mensa-Wilmot ..... E21B 7/28
9,273,519 B2 * 3/2016 Smith ..... E21B 10/26
9,593,538 B2 3/2017 Rasheed
9,739,094 B2 * 8/2017 Moreno, II ..... E21B 10/26
9,864,821 B2 * 1/2018 Chen ..... E21B 10/43
2001/0020552 A1 9/2001 Beaton et al.
2002/0166703 A1 * 11/2002 Presley ..... E21B 10/16 175/391
2003/0029644 A1 2/2003 Hoffmaster et al.
2003/0155155 A1 * 8/2003 Dewey ..... E21B 7/067 175/57
2004/0188149 A1 9/2004 Thigpen et al.
2004/0222022 A1 11/2004 Nevlud et al.
2005/0034897 A1 2/2005 Youan
2007/0089912 A1 4/2007 Eddison et al.
2007/0163808 A1 * 7/2007 Campbell ..... E21B 10/322 175/57
2007/0205024 A1 * 9/2007 Mensa-Wilmot ..... E21B 10/43 175/408
2008/0128174 A1 * 6/2008 Radford ..... E21B 10/322 175/267
2008/0128175 A1 * 6/2008 Radford ..... E21B 10/322 175/269
2008/0149396 A1 6/2008 Fyfe
2008/0190670 A1 * 8/2008 Welch ..... E21B 10/43 175/430
2008/0314645 A1 * 12/2008 Hall ..... E21B 10/43 175/374
2009/0145666 A1 * 6/2009 Radford ..... E21B 10/30 175/269
2009/0294178 A1 12/2009 Radford
2009/0321138 A1 * 12/2009 Shamburger ..... E21B 10/43 175/61
2010/0012387 A1 * 1/2010 Huynh ..... E21B 10/43 175/428
2010/0018779 A1 * 1/2010 Makkar ..... E21B 10/322 175/382
2010/0051349 A1 * 3/2010 Ballard ..... E21B 10/26 175/57
2010/0089649 A1 * 4/2010 Welch ..... E21B 10/43 175/61
2010/0263875 A1 10/2010 Williams et al.
2010/0276201 A1 * 11/2010 Makkar ..... E21B 7/28 175/57
2011/0005836 A1 1/2011 Radfprd et al.
2011/0005841 A1 1/2011 Wood et al.
2011/0120777 A1 5/2011 Lee
2011/0127087 A1 * 6/2011 Hareland ..... E21B 10/602 175/393
2011/0259650 A1 * 10/2011 Hall ..... E21B 10/43 175/430
2012/0012398 A1 1/2012 Hall et al.
2012/0073879 A1 * 3/2012 Makkar ..... E21B 10/322 175/406
2012/0138365 A1 * 6/2012 Maurstad ..... E21B 10/43 175/57
2012/0152543 A1 6/2012 Davis
2012/0152623 A1 * 6/2012 Chen ..... E21B 10/43 175/428
2012/0205151 A1 8/2012 Inoue et al.
2012/0205157 A1 8/2012 Radford et al.
2012/0255786 A1 * 10/2012 Isenhour ..... E21B 10/26 175/57
2013/0075167 A1 * 3/2013 Knull ..... E21B 10/43 175/428
2013/0087386 A1 4/2013 Radford et al.
2013/0146361 A1 * 6/2013 Makkar ..... E21B 10/322 175/57
2013/0199855 A1 8/2013 Shears
2013/0256036 A1 10/2013 Lyons
2013/0306380 A1 * 11/2013 Oesterberg ..... E21B 10/32 175/263
2013/0341100 A1 * 12/2013 Zhang ..... E21B 10/46 175/375
2014/0008128 A1 * 1/2014 Adam ..... E21B 10/32 175/57
2014/0048335 A1 * 2/2014 Mensa-Wilmot ..... E21B 7/28 175/263
2014/0048336 A1 * 2/2014 Mensa-Wilmot ..... E21B 10/32 175/266
2014/0246247 A1 * 9/2014 Smith ..... E21B 10/26 175/394
2014/0262523 A1 9/2014 Davis
2014/0278282 A1 * 9/2014 Chen ..... E21B 10/43 703/1

(56) References Cited

U.S. PATENT DOCUMENTS

| | | | | |
|---|---|---|---|---|
| 2015/0068813 | A1* | 3/2015 | Moreno, II | E21B 10/26 175/263 |
| 2015/0144405 | A1* | 5/2015 | Salvo | E21B 10/322 175/263 |
| 2016/0290067 | A1* | 10/2016 | Tipples | E21B 17/1078 |
| 2016/0305190 | A1 | 10/2016 | Johnson et al. | |
| 2017/0058611 | A1* | 3/2017 | Lin, Jr. | E21B 10/43 |
| 2017/0204670 | A1* | 7/2017 | Hird | E21B 10/322 |
| 2017/0211332 | A1* | 7/2017 | Hird | E21B 10/322 |
| 2017/0211333 | A1* | 7/2017 | Hird | E21B 10/322 |
| 2017/0211334 | A1* | 7/2017 | Hird | E21B 10/322 |
| 2017/0211335 | A1* | 7/2017 | Hird | E21B 10/43 |
| 2017/0218707 | A1* | 8/2017 | Hird | E21B 10/567 |
| 2018/0094496 | A1* | 4/2018 | Su | E21B 29/002 |
| 2018/0179825 | A1* | 6/2018 | Johnson | E21B 10/322 |

FOREIGN PATENT DOCUMENTS

| | | | | |
|---|---|---|---|---|
| CN | 102086756 | A | 6/2011 | |
| EP | 0385673 | A1 | 9/1990 | |
| EP | 0397417 | A1 | 11/1990 | |
| EP | 0869256 | A2 | 7/1998 | |
| EP | 0869256 | A2 | 10/1998 | |
| EP | 1811124 | A1 | 7/2007 | |
| EP | 2097610 | A1 | 9/2009 | |
| GB | 2339227 | A | 1/2000 | |
| GB | 2417267 | A | 2/2006 | |
| GB | 2520998 | A | 6/2015 | |
| WO | 03102354 | A1 | 12/2003 | |
| WO | 2004101943 | A2 | 11/2004 | |
| WO | 2005047644 | A1 | 5/2005 | |
| WO | 2005052301 | A2 | 6/2005 | |
| WO | 2007041811 | A1 | 4/2007 | |
| WO | 2008100194 | A2 | 8/2008 | |
| WO | 2010126938 | A2 | 11/2010 | |
| WO | 2013134629 | A1 | 9/2013 | |
| WO | 2013167954 | A2 | 11/2013 | |
| WO | WO-2013173607 | A1 * | 11/2013 | E21B 10/32 |
| WO | 2014028457 | A1 | 2/2014 | |
| WO | 2014150524 | A2 | 9/2014 | |
| WO | 2014159079 | A1 | 10/2014 | |
| WO | 2015054227 | A2 | 4/2015 | |
| WO | WO-2015167786 | A1 * | 11/2015 | E21B 10/322 |
| WO | WO-2015167788 | A1 * | 11/2015 | E21B 10/43 |

OTHER PUBLICATIONS

Search Report under Section 17 of U.K. Patent Application No. 1412934.0, dated Jan. 16, 2015, 4 pages.
Exam Report under Section 18(3) of U.K. Patent Application No. 1412934.0, dated Sep. 2, 2016, 2 pages.
Search Report and Written Opinion of International Patent Application No. PCT/US2015/041224, dated Oct. 8, 2015, 11 pages.
Office Action issued in U.S. Appl. No. 15/328,051, dated Aug. 24, 2018, 22 pages.
Search Report under Section 17(5) of U.K. Patent Application No. 1412933.2, dated Dec. 22, 2015, 4 pages.
Search Report under Section 17(5) of U.K. Patent Application No. 1412932.4, dated Jan. 16, 2015, 3 pages.
Exam Report under Section 18(3) of U.K. Patent Application No. 1412932.4, dated Jan. 23, 2018, 4 pages.
Exam Report under Section 18(3) of U.K. Patent Application No. 1412932.4, dated Nov. 18, 2016, 5 pages.
Search Report and Written Opinion of International Patent Application No. PCT/US2015/041265, dated Oct. 8, 2015, 12 pages.
Search Report under Section 17(5) of U.K. Patent Application No. 1412932.4, dated Jan. 12, 2015, 3 pages.
Search Report and Written Opinion of International Patent Application No. PCT/US2015/041223, dated Oct. 19, 2015, 11 pages.
Search Report under Section 17(5) of U.K. Patent Application No. 1412929.0, dated Jan. 12, 2015, 3 pages.
Combined Search and Exam Report under Sections 17 and 18(3) of U.K. Patent Application No. 1321625.4, dated Nov. 25, 2015, 8 pages.
Search Report and Written Opinion of International Patent Application No. PCT/US2015/041280, dated Oct. 13, 2015, 12 pages.
Combined Search and Exam Report under Sections 17 and 18(3) of U.K. Patent Application No. 1412930.8, dated Jan. 12, 2015, 5 pages.
Search Report and Written Opinion of International Patent Application No. PCT/US2015/040295, dated Oct. 12, 2015, 12 pages.
Combined Search and Exam Report under Sections 17 and 18(3) of U.K. Patent Application No. 1321625.4, dated May 7, 2014, 5 pages.
European Search Report of related EP Patent Application No. 14868423.6, dated Nov. 23, 2016, 3 pages.
European Exam Report of related EP Patent Application No. 14868423.6, dated Jan. 3, 2017, 5 pages.
Office Action issued in U.S. Appl. No. 15/102,039, dated Jun. 1, 2018, 15 pages.

* cited by examiner

REAMER

CROSS-REFERENCE TO RELATED APPLICATION

This application claims priority to UK Patent Application No. 1412933.2, which is incorporated herein in its entirety by reference.

BACKGROUND

One practice which may be employed when drilling a borehole is to enlarge a hole with a reamer. A reamer may be constructed to have a fixed diameter, in which case the reamer must start cutting at the surface or at the end of an existing hole of equal or greater size. Alternatively a reamer can be constructed so as to be expandable so that it can enlarge a borehole to a greater diameter than that of the hole through which the (unexpanded) reamer was inserted.

Enlarging a borehole with a reamer may be done as a separate operation to enlarge an existing borehole drilled at an earlier time. Enlarging with a reamer may also be done at the same time as using a bottom hole assembly which has a drill bit at its bottom end. The drill bit makes an initial hole, sometimes referred to as pilot hole, and a reamer positioned at some distance above the drill bit increases the hole diameter.

There is more than one type of reaming tool. Some reamers are constructed to be eccentric, relative to the drill string to which they are attached and the borehole which they are enlarging. Other reamers are constructed to remain concentric with the drill string and the borehole. These different types of reamers tend to be used in different circumstances. There are many instances where concentric reamers are the appropriate choice.

A reamer may have a plurality of cutter assemblies, each comprising a support structure with attached cutters, arranged azimuthally around the axis of the tool. In the case of an expandable reaming tool it is common to have a plurality of radially expandable support elements bearing cutters positioned around the axis of the tool. Often the tool has three such cutter assemblies which extend axially and are arranged at 120° intervals azimuthally around the tool axis. A mechanism is provided for expanding these cutter assemblies radially outwardly from the axis and this mechanism typically uses hydraulic pressure to force the support structures of the cutter assemblies outwardly.

This tool construction has commonly been used for concentric reamers. In some constructions, each of the individual cutter assemblies arranged around the tool axis is an assembly of parts attached together so as to move bodily as one piece, in which case the assembly is often referred to as a "block" (one part of this assembly may be a shaped monolithic block) although the term "arm" has also been used for such an assembly. The individual cutter assemblies (i.e. individual blocks) may be moved outwards in unison by one drive mechanism acting on them all, or may be moved outwards by drive mechanism(s) which does not constrain them to move in unison.

Cutters attached to the supporting structure may be hard faced and may be PDC cutters having body with a polycrystalline diamond section at one end. The body may be moulded from hard material such as tungsten carbide particles infiltrated with metallic binder. The polycrystalline diamond section which provides the cutting part may then comprise particles of diamond and a binder. In many instances, the polycrystalline diamond section is a disc so that the hardest end of a cutter is a flat surface but other shapes can also be used.

Cutters are customarily positioned so that they are partially embedded in the support structure and project radially outwardly from the support structure with their hard cutting surfaces facing in the direction of rotation. The parts of the cutter which project outwardly beyond the support structure are the parts of the cutter involved in cutting as the rotating reamer is advanced and/or as an expandable reamer is expanded.

SUMMARY

This summary is provided to introduce a selection of concepts that are further described below. This summary is not intended to be used as an aid in limiting the scope of the subject matter claimed.

In one aspect, the subject matter disclosed here provides a reaming tool for enlarging an underground borehole, comprising a plurality of cutter assemblies distributed azimuthally around a longitudinal axis of the tool, wherein each cutter assembly includes an axially extending length comprising supporting structure bearing a sequence of axially distributed cutters which have hard surfaces facing in a direction of rotation of the tool. Broadly there are at least two assemblies which differ so that a plurality of the cutters on the second cutter assembly are at axial positions relative to the tool which are intermediate between axial positions of the cutters on the first cutter assembly.

It is possible that a tool could have two cutter assemblies diametrically opposite, or there could be four assemblies at 90° intervals around the tool, with the third and fourth assemblies identical to the first and second respectively. However there may be three (or possibly more) cutting assemblies such that the second differs from the first, as above and a plurality of the cutters on the third cutter assembly are at axial positions which are intermediate between axial positions of the cutters on the first cutter assembly and also intermediate between axial positions of the cutters on the second cutter assembly.

One possible implementation is that a number of cutters in the sequence have a configuration in which axial positions of the cutters, relative to each other, are the same on each cutter assembly, but on different cutter assemblies the cutters with this configuration are positioned at differing axial distances from an axial end of the tool. Consequently, on assemblies which follow the first one in succession during rotation of the tool, corresponding points in the configuration of cutters are at increasing axial distances from the end of the tool.

The difference between the smallest and largest distances from the end of the tool to corresponding points in a repeated configuration of cutters may be less than the distance between two adjacent cutters of a sequence. Consequently, the distances from the end of the tool to the first cutter of each sequence of cutters on a plurality of cutter assemblies may not exceed the smallest distance from the end of the tool to the second cutter of any sequence. Stating this more generally, the various distances from the end of the tool to corresponding cutters of the sequences may not exceed the smallest distance from the end of the tool to the subsequent cutter of any of the sequences.

In some forms of the subject matter disclosed here, cutters in the plurality of sequences (the sequences on the plurality of assemblies) are positioned at radial distances from the tool axis which progressively increase as axial distance from an end of the tool increases.

The sequences on the plurality of assemblies may contain a configuration of cutters in which both radial as well as axial positions of the cutters, relative to each other, are the same on each assembly. On assemblies which follow one another in succession during rotation of the tool, corresponding points in such configurations of cutters may be at increasing radial distances from the axis of the tool as well as increasing axial distances from the end of the tool. In one possible arrangement, radial extremities of corresponding cutters in the sequences may lie on a helix around the axis of the tool with a spacing between adjacent turns of the helix which is the same as an axial spacing between successive cutters in a sequence.

With these geometrical arrangements, the cutters on a length of each cutter assembly may be arranged as a single sequence of axially distributed cutters, which contrasts with some conventional arrangements which have two sequences of cutters, one positioned circumferentially behind the other. Reducing the number of cutters is beneficial because the cutters themselves are a costly component.

Arranging the cutters so that axial positions vary from one cutter assembly to another may share the cutting action amongst the cutting assemblies. If the cutters are in a single sequence on each cutter assembly, it may give more effective cutting action when the rate of axial advance of the tool is small. Arranging the cutters so that their radial distances from the tool axis progressively increase as their axial distance from an end of the tool increases may go further in distributing the task of cutting among the cutters and so may distribute reaction forces on the tool and inhibit sudden jerks and vibration so as to facilitate a smooth cutting action.

In further aspects, this disclosure includes methods of enlarging a borehole by rotating a reaming tool as defined above in the borehole and advancing the tool axially. The method may include expanding a reaming tool which has expandable cutter assemblies and then rotating the tool while also advancing the expanded tool axially.

DETAILED DESCRIPTION

Figure 1:
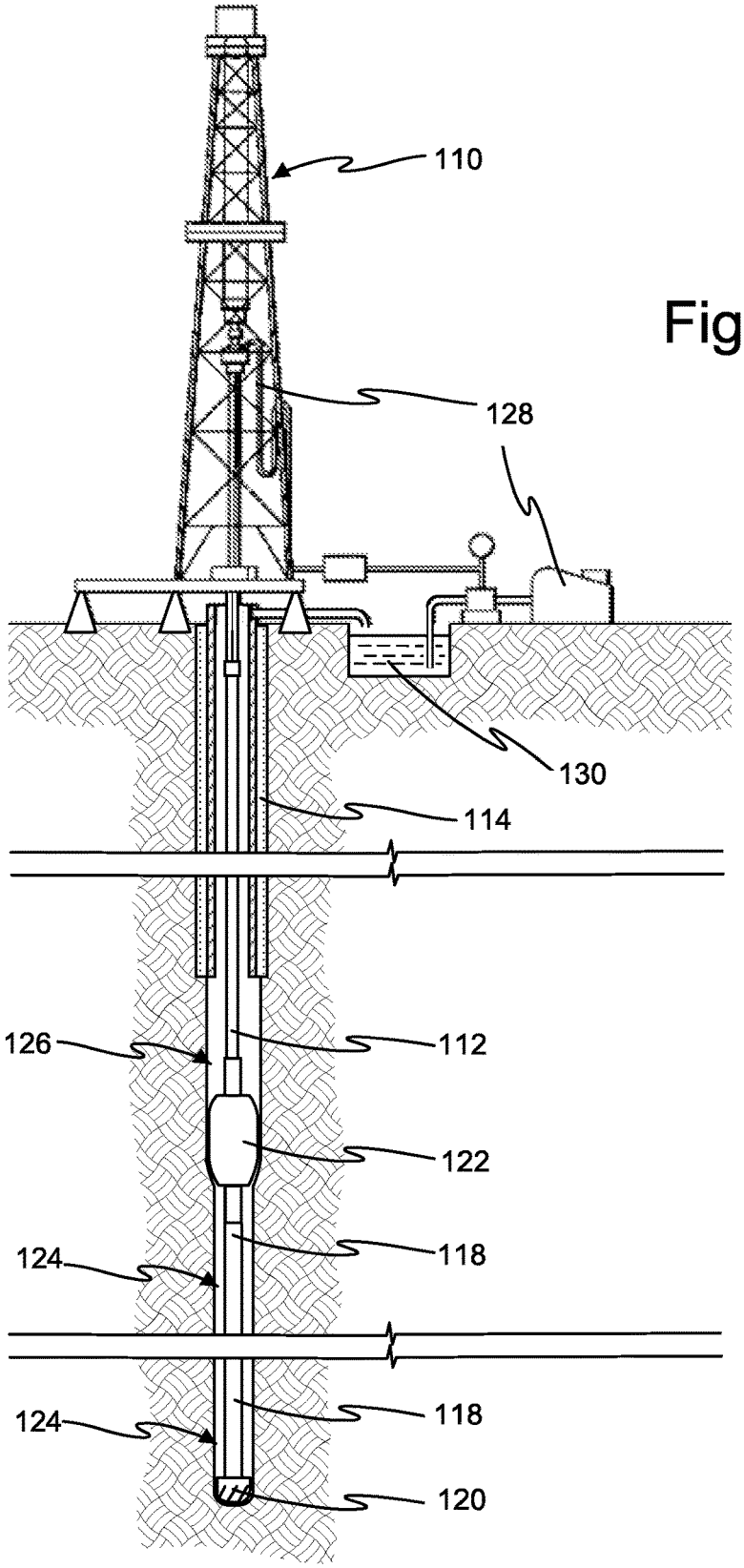
FIG. 1 is a schematic, cross-sectional view of a drilling assembly in a borehole.

FIG. 1 shows an exemplary drilling assembly which includes an expandable under-reamer 122. A drill string 112 extends from a drilling rig 110 into a borehole. An upper part of the borehole has already been lined with casing and cemented as indicated at 114. The drill string 112 is connected to a bottomhole assembly 118 which includes a drill bit 120 and an under-reamer 122 which has been expanded beneath the cased section 114. As the drill string 112 and bottomhole assembly 118 are rotated, the drill bit 120 extends a pilot hole 124 downwards while the reamer 122 simultaneously opens the pilot hole 124 to a larger diameter borehole 126.

The drilling rig is provided with a system 128 for pumping drilling fluid from a supply 130 down the drill string 112 to the reamer 122 and the drill bit 120. Some of this drilling fluid flows through passages in the reamer 122 and flows back up the annulus around the drill string 112 to the surface. The rest of the drilling fluid flows out through passages in the drill bit 120 and also flows back up the annulus around the drill string 112 to the surface. The distance between the reamer 122 and the drill bit 120 at the foot of the bottom hole assembly is fixed so that the pilot hole 124 and the enlarged borehole 126 are extended downwardly simultaneously.

Figure 5:
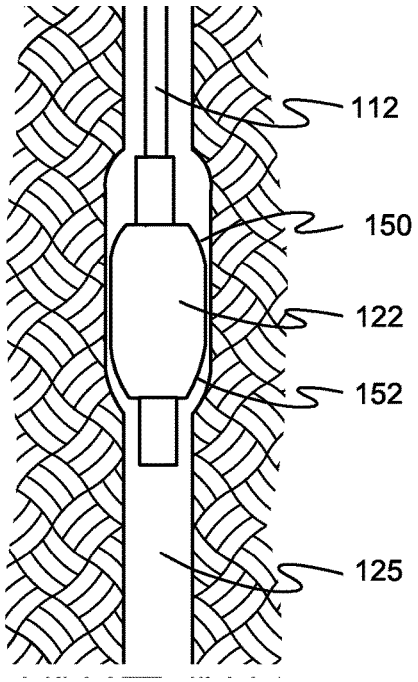
FIG. 5 is a schematic, cross-sectional view of the reamer expanded in a preexisting borehole.

As shown in FIG. 5, it would similarly be possible to use the same reamer 122 attached to drill string 112, although without the drill bit 120 and the part of the bottom hole assembly 118 shown below the reamer 122 in FIG. 1, to enlarge a borehole 125 which had been drilled previously. In FIG. 5, the initial expansion of the reamer has created a fairly short section where the borehole has enlarged diameter. This enlarged portion of the borehole can then be elongated downwardly by advancing the drill string 112 and reamer 122 downwardly.

Figure 2:
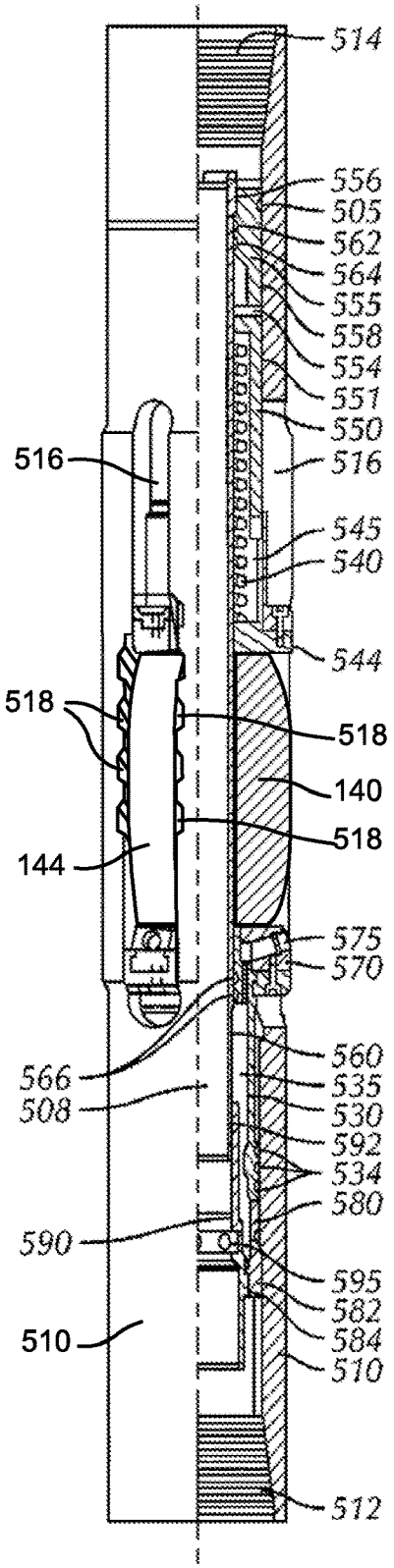
FIG. 2 is a cross-sectional elevation view of one embodiment of expandable reamer, showing its expandable cutter blocks in collapsed position.
Figure 3:
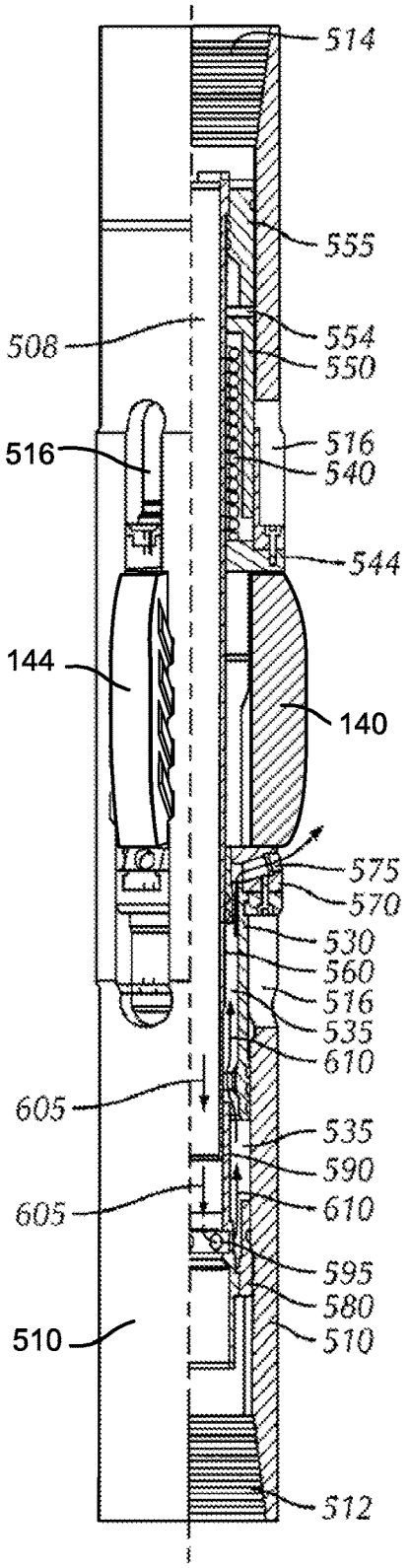
FIG. 3 is a cross-sectional elevation view of the expandable reamer of FIG. 2, showing the cutter blocks in expanded position.

Referring now to FIGS. 2 and 3, one embodiment of expandable reaming tool is shown in a collapsed position in FIG. 2 and in an expanded position in FIG. 3. The expandable tool comprises a generally cylindrical tool body 510 with a central flowbore 508 for drilling fluid. The tool body 510 includes upper 514 and lower 512 connection portions for connecting the tool into a drilling assembly. Intermediately between these connection portions 512, 514 there are three recesses 516 formed in the body 510 and spaced apart at 120° intervals azimuthally around the axis of the tool.

Each recess 516 accommodates a cutter support element 140 in its collapsed position. This support element has the general form of a block to which cutters are attached. One such cutting block 140 is shown in perspective in FIG. 4. The block 140 has an outer face 144 which confronts the wall of the borehole and side faces with protruding ribs 142 which extend at an angle to the tool axis. These ribs 142 engage in channels 518 at the sides of a recess 516 and thus provide a guide mechanism such that when the block 140 is pushed upwardly relative to the tool body 510, it also moves radially outwardly to the position shown in FIG. 3 in which the blocks 140 extend radially outwardly from the tool body 510. The blocks move in unison and so are all at the same axial positions relative to the tool body. Details of the outer face 144 of a block 140 have been omitted from FIGS. 2 and 3.

A spring 540 biases the block 140 downwards to the collapsed position of FIG. 2. The biasing spring 540 is disposed within a spring cavity 545 and covered by a spring retainer 550 which is locked in position by an upper cap 555. A stop ring 544 is provided at the lower end of spring 540 to keep the spring in position.

Below the moveable blocks 140, a drive ring 570 is provided that includes one or more nozzles 575. An actuating piston 530 that forms a piston cavity 535 is attached to the drive ring 570. The piston 530 is able to move axially within the tool. An inner mandrel 560 is the innermost component within the tool 500, and it slidingly engages a lower retainer 590 at 592. The lower retainer 590 includes ports 595 that allow drilling fluid to flow from the flowbore 508 into the piston chamber 535 to actuate the piston 530.

The piston 530 sealingly engages the inner mandrel 560 at 566, and sealingly engages the body 510 at 534. A lower cap 580 provides a stop for the downward axial movement of piston 530. This cap 580 is threadedly connected to the body 510 and to the lower retainer 590 at 582, 584, respectively. Sealing engagement is provided at 586 between the lower cap 580 and the body 510.

A threaded connection is provided at 556 between the upper cap 555 and the inner mandrel 560 and at 558 between the upper cap 555 and body 510. The upper cap 555 sealingly engages the body 510 at 505, and sealingly engages the inner mandrel 560 at 562 and 564.

In operation, drilling fluid flows along path 605, through ports 595 in the lower retainer 590 and along path 610 into the piston chamber 535. The differential pressure between the fluid in the flowbore 508 and the fluid in the borehole annulus surrounding tool 500 causes the piston 530 to move axially upwardly from the position shown in FIG. 2 to the position shown in FIG. 3. A small amount of flow can pass through the piston chamber 535 and through nozzles 575 to the annulus as the tool 500 starts to expand. As the piston 530 moves axially upwardly, it urges the drive ring 570 axially upwardly against the blocks 140. The drive ring pushes on all the blocks 140 simultaneously and moves them all axially upwardly in recesses 516 and also radially outwardly as the ribs 142 slide in the channels 518. The blocks 140 are thus driven upwardly and outwardly in unison towards the expanded position shown in FIG. 3.

The movement of the blocks 140 is eventually limited by contact with the spring retainer 550. When the spring 540 is fully compressed against the retainer 550, it acts as a stop and the blocks can travel no further. There is provision for adjustment of the maximum travel of the blocks 140. The spring retainer 550 connects to the body 510 via a screwthread at 551. A wrench slot 554 is provided between the upper cap 555 and the spring retainer 550, which provides room for a wrench to be inserted to adjust the position of the screwthreaded spring retainer 550 in the body 510. This allows the maximum expanded diameter of the reamer to be set at the surface. The upper cap 555 is also a screwthreaded component and it is used to lock the spring retainer 550 once it has been positioned.

Figure 4:
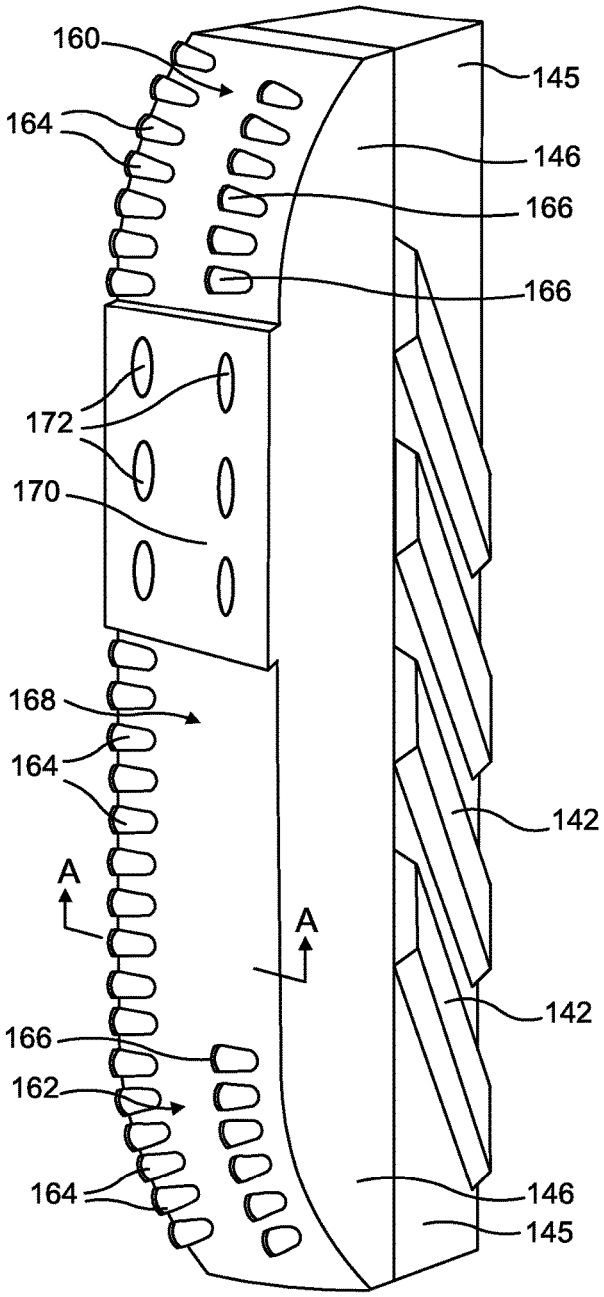
FIG. 4 is a perspective view of a cutter block for the expandable reamer of FIGS. 2 and 3.

FIG. 4 is a perspective view of a cutter block 140 showing the outer face of the block and the side face which is the trailing face in the direction of rotation. There is a conventional arrangement of cutters on the outer face. The block is formed of an inner part 145 and an outer part 146 bolted to the part 145 by bolts (not shown). The inner part 145 is steel and incorporates the protruding ribs 142. The outer part 146 of the block 140 is also steel and has polycrystalline diamond (PDC) cutters secured to it.

Figure 6:
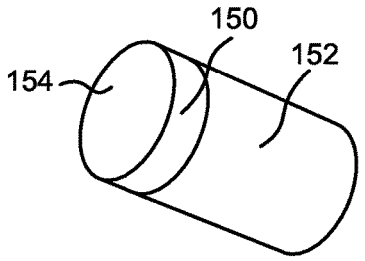
FIG. 6 is a detail view of a PDC cutter.

As shown in FIG. 6 such cutters have a sintered disc 150 of diamond crystals embedded in a binder material. This disc is at one end of a cylindrical body 152 which may be a sintered mass of tungsten carbide particles and a binder material. The bodies 152 of cutters are secured, for example by brazing, to the outer part 146 of the block 140 so that the hard faces 154 of the cutters are exposed. Although the cutter shown in FIG. 6 has a hard surface 154 which is a flat face, other shapes including cones can be used for the hard surface.

The outer part 146 of the block 140 has upper and lower cutting portions 160, 162 on which PDC cutters are arranged in a leading row of cutters 164 and a following row of cutters 166. It will be appreciated that the upper and lower cutting portions 160, 162 are inclined (they are curved as shown) so that the cutters in these regions extend outwards from the tool axis by amounts which are least at the top and bottom ends of the block 140 and greatest adjacent the middle section 168 which includes stabilising pad 170.

When a reamer is advanced downwardly within a hole to enlarge the hole, it is the curved lower cutting portions 162 which do the work of cutting through formation rock. This takes place in FIGS. 1 and 5 as the drill string is advanced. The enlarged portion of the borehole can also be extended upwardly using the cutting portions 160 on the blocks 140 to remove formation rock while pulling upwardly on the drill string 112. The leading row of cutters 164 has the cutters positioned side by side and spaced axially apart. The following row of cutters 166 also has the cutters spaced apart but the cutters in this following row are positioned circumferentially behind the spaces between adjacent cutters in the front row. If a portion of the rock to be cut passes between cutters of the leading row, it is cut by a cutter of the trailing row.

The stabilising pad 170 does not include cutters but has a generally smooth, part-cylindrical outward surface positioned to face and slide over the borehole wall. To increase resistance to wear, the stabilising pad 170 may have pieces 172 of harder material embedded in it and lying flush with the outward facing surface.

Figure 7:
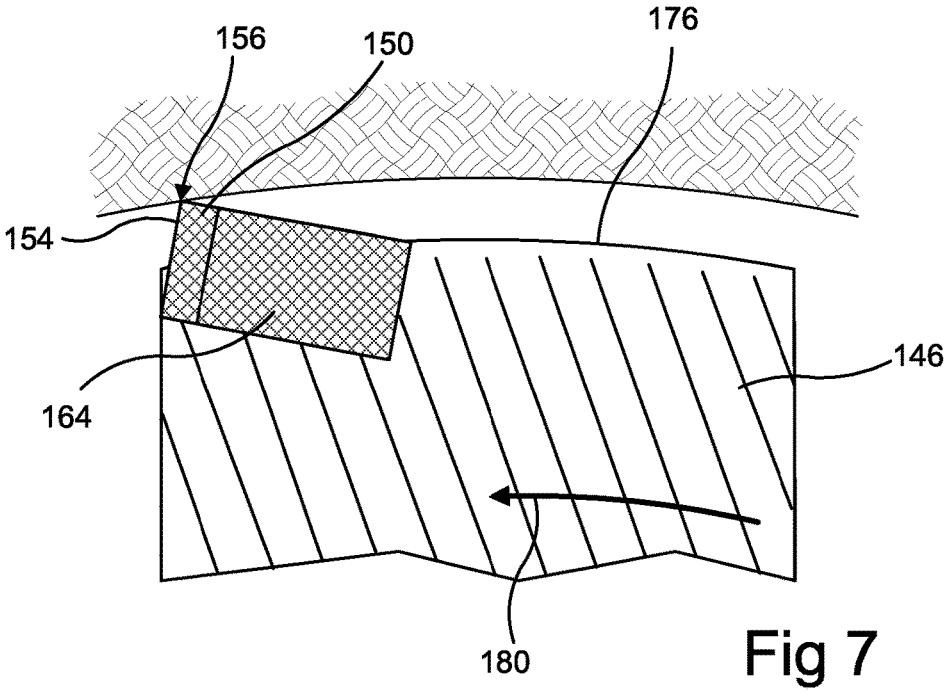
FIG. 7 is a cross section on line A-A of FIG. 4.

FIG. 7 is a section on line A-A of FIG. 4 showing one front row PDC cutter 164 mounted to the outer part 146 of the block 142. The cutter 164 is partially embedded in the outer part 146 and is oriented so that the hard face 154 will be facing forwards when the reamer is rotated. The direction of rotation is indicated by arrow 180. This hard face extends outwards to an extremity 156 which is at the maximum radius swept by the rotating reamer (i.e. its full gauge). The extremities of the other PDC cutters secured to the middle region 168 are also at the maximum radius swept by the rotating reamer. The outer surface of the support structure is indicated at 176.

Figure 8:
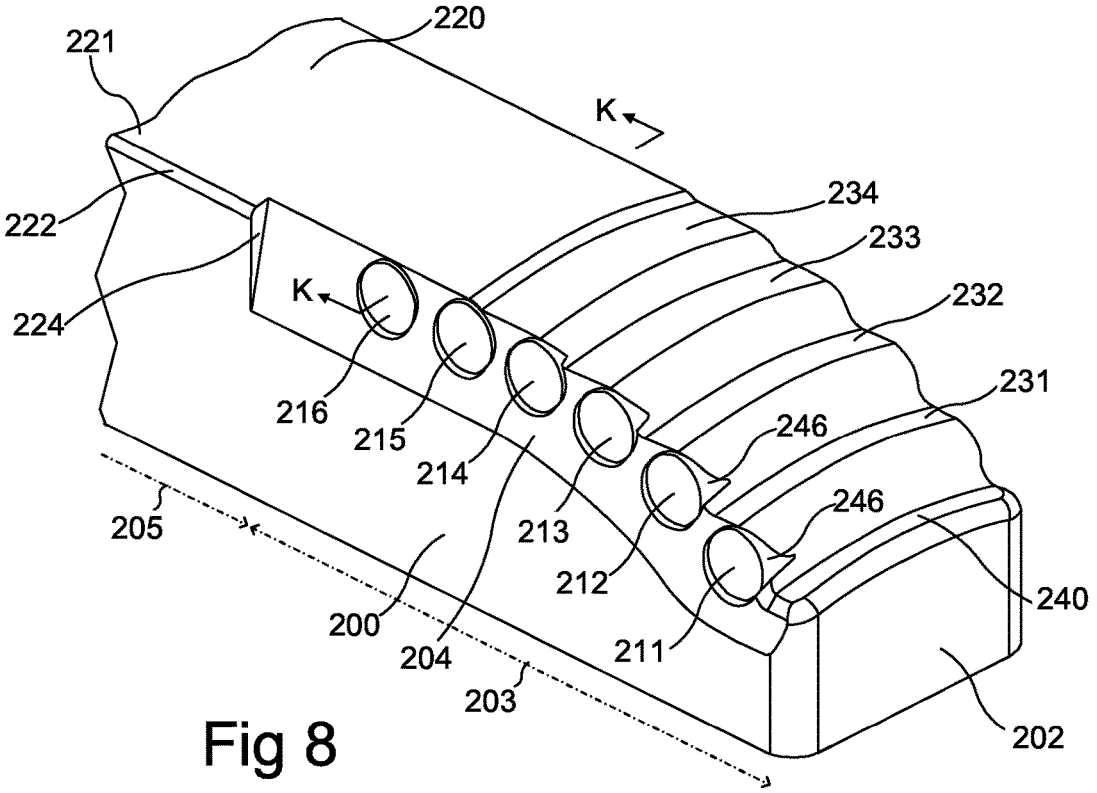
FIG. 8 is an isometric drawing of the lower cutting portion of the outer part of a cutter block, with the tool axis horizontal.

The reamer as described above, referring to FIGS. 1 to 7, is of a conventional construction. FIG. 8 onwards show parts of expandable reamers which utilise much of this conventional construction but have cutter arrangements and cutter blocks in accordance with the novel concepts disclosed here. Specifically, the reamers of FIGS. 8 to 20 utilise the expandable block construction shown in FIGS. 2 and 3 and have cutter blocks with inner and outer parts as in FIG. 4. However, the construction of the outer parts of the cutter blocks and the arrangement of the cutters on the blocks is different from that shown in FIG. 4 and is in accordance with novel aspects of the present disclosure.

Figure 9:
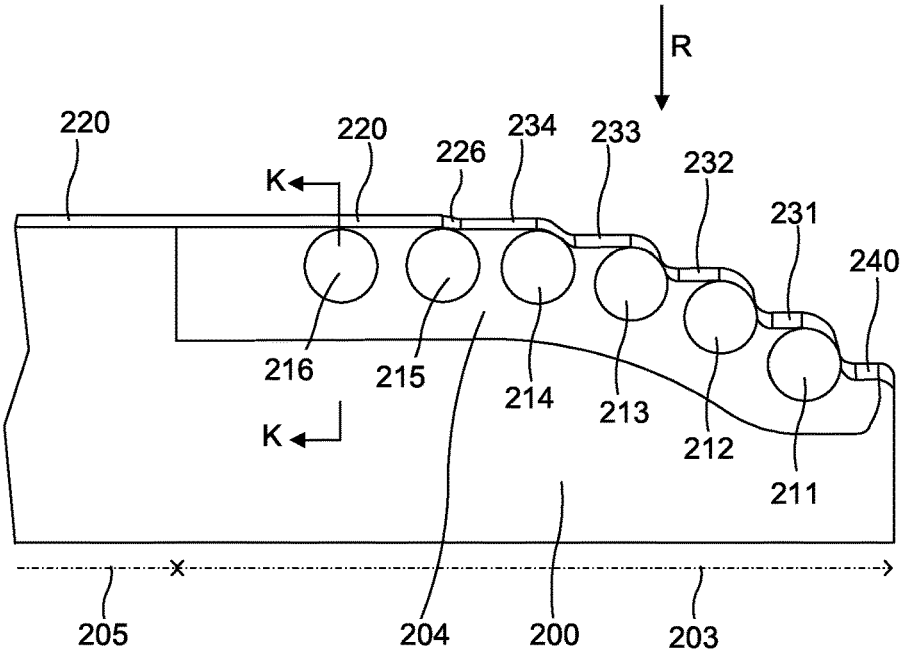
FIG. 9 is a side view of the lower cutting portion shown in FIG. 8, again with the tool axis horizontal.
Figure 10:
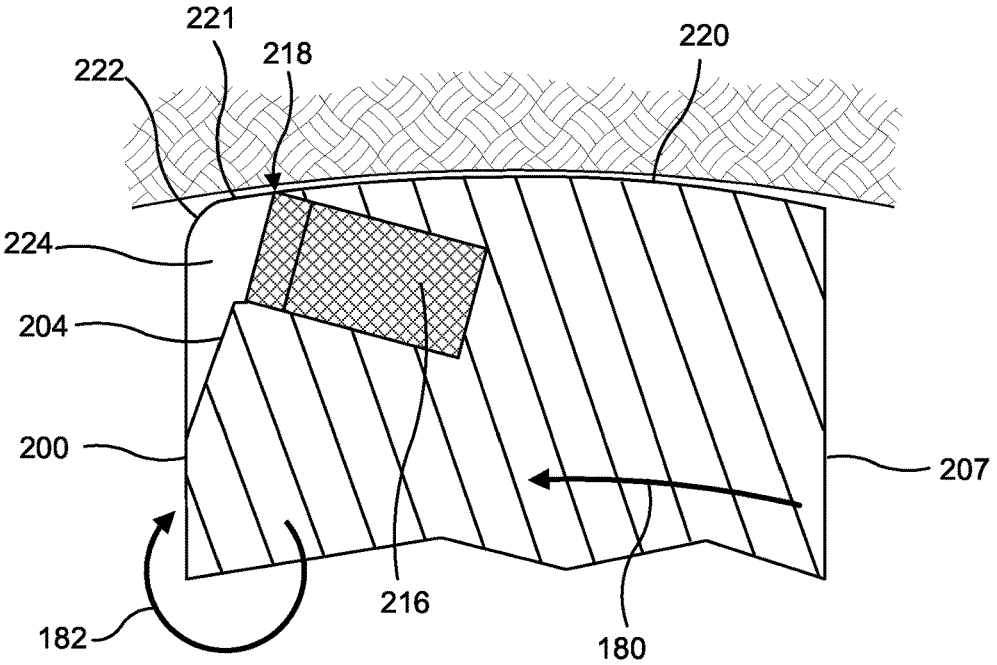
FIG. 10 is a cross section on the line K-K of FIGS. 8 and 9.

As with the conventional construction, the outer part of each cutter block is a steel support structure for PDC cutters. FIGS. 8 to 10 show the lower cutting portion of the outer part of a cutter block. In these figures the tool axis is shown as horizontal. The block has a side face 200 which is the leading face in the direction of rotation and it has a lower axial end face 202. For part of its length indicated 203, the side of the block has an area 204 which is slanted back as shown by FIG. 10. The trailing face of the block is indicated 207 in FIG. 10.

A row of PDC cutters 211-216 is positioned with the hard surfaces of the cutters exposed within the slanted area 204 of the leading face of the block. The cutters are fitted into sockets in the steel supporting structure and secured by brazing so that they are embedded in the supporting structure. The cutters 211-215 are positioned at progressively increasing radial distances from the tool axis. The next cutter 216 is at the same radial distance from the tool axis as cutter 215.

These cutters 211-216 arranged in a single sequence with the cutters side-by-side are the only cutters on the lower portion of the cutter block. In contrast with FIG. 4, there is no second row of cutters behind.

This length 203 of the block with the slanted area 204 and cutters 211-216 adjoins a length 205 which does not include cutters and provides a stabilising pad with a part-cylindrical outward facing surface 220 which includes a leading region 221 which extends forwardly (in the direction of rotation) of the cutter 216. The leading side surface 200 of the block extends outwards to meet the region 221 of surface 220 at an edge 222 with the consequence that there is a surface 224 facing axially at one end of the slanted area 204. As best seen in the cross-section which is FIG. 10, the edge 222 is a curved transition between the surfaces 200 and 220.

The outer surface 220 of the stabilising pad is at the full gauge of the reamer and so when the cutter blocks are fully expanded, the outer surface 220 is part of a cylinder which is centred on the tool axis and lies on the notional surface swept out by the rotating tool. The outer extremities of the cutters 215 and 216 are also at the full gauge of the reamer and also lie on this notional surface. This notional surface is akin to a surface of revolution, because it is the surface swept out by a rotating body, but of course the reamer may be advancing axially as it rotates.

The outer surface 220 extends axially over the cutter 216 and over half of cutter 215. Thus, as shown by the cross-section in FIG. 11, the cutter 216 (and also cutter 215) has its extremity 218 aligned with outwardly facing surface area which is behind the leading faces of these cutters 215, 216 and follows these leading faces as the reamer rotates. The block thus has a surface 220 which faces outwardly at full gauge and is larger than the surface area within the length 205 of the stabilising pad.

The shape of the block inhibits any pivoting around the extremities of cutters during rotation. If the extremity 218 snags on the borehole wall, any pivoting around the extremity 218 in the sense seen as clockwise and denoted by arrow 182 in FIG. 10 is limited by the leading region 221 of surface 220 abutting the borehole wall. Pivoting in the opposite sense is less likely but is limited by the trailing part of surface 220 abutting the borehole wall. The leading edge 222 is formed as a smooth curve so as to inhibit this leading edge from snagging on the borehole wall during rotation.

The cutters 211-214 are embedded in the outer part of the block in a similar manner to the cutters 215, 216. The outer face of the block includes part-cylindrical surfaces 231-234 which extend behind the leading faces of cutters 211-214 respectively and which are aligned radially with the extremities of the respective cutters. Each of the part-cylindrical surfaces 231-234 has a radius which lies on the tool axis when the cutter blocks are fully expanded.

These surfaces 231-234 act as secondary gauge areas: the surface 231 slides over rock which has just been cut by the action of cutter 211, surface 232 slides over rock cut by cutter 232 and so on. Of course, the rock surfaces created by cutters 211-214 have only a transient existence. They are cut away by cutters at a greater radius as the reamer advances. Nevertheless, this provision of secondary gauge areas contributes to stabilisation of the position of the rotating reamer.

Figure 11:
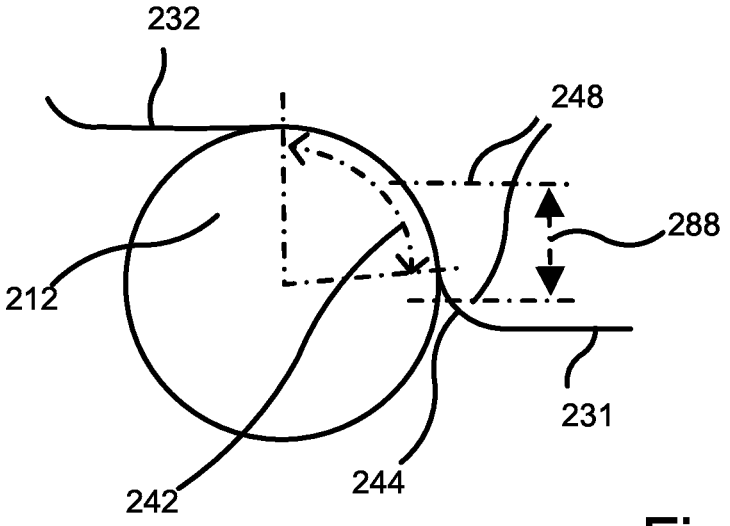
FIG. 11 is a diagrammatic enlarged view showing one cutter of FIG. 9.

The outer face of the block includes portions connecting the part cylindrical surfaces 231-234. Referring to FIG. 11, from the surface 232 towards surface 231 the outer face of the block curves through an arc (indicated by angle 242) where it is aligned with the perimeter of cutter 232. It then curves in the opposite sense, as seen at 244, to join the part cylindrical surface 231. There is a similar arrangement between surfaces 234 and 233, between 233 and 232 and also between surface 231 and a part cylindrical surface 240 located between cutter 211 and the axial end of the block. This geometry allows small areas of the cylindrical surfaces of the cutters to remain visible as for example indicated at 246. The surface 220 is connected to surface 234 by a small tapered face 226.

Figure 13:
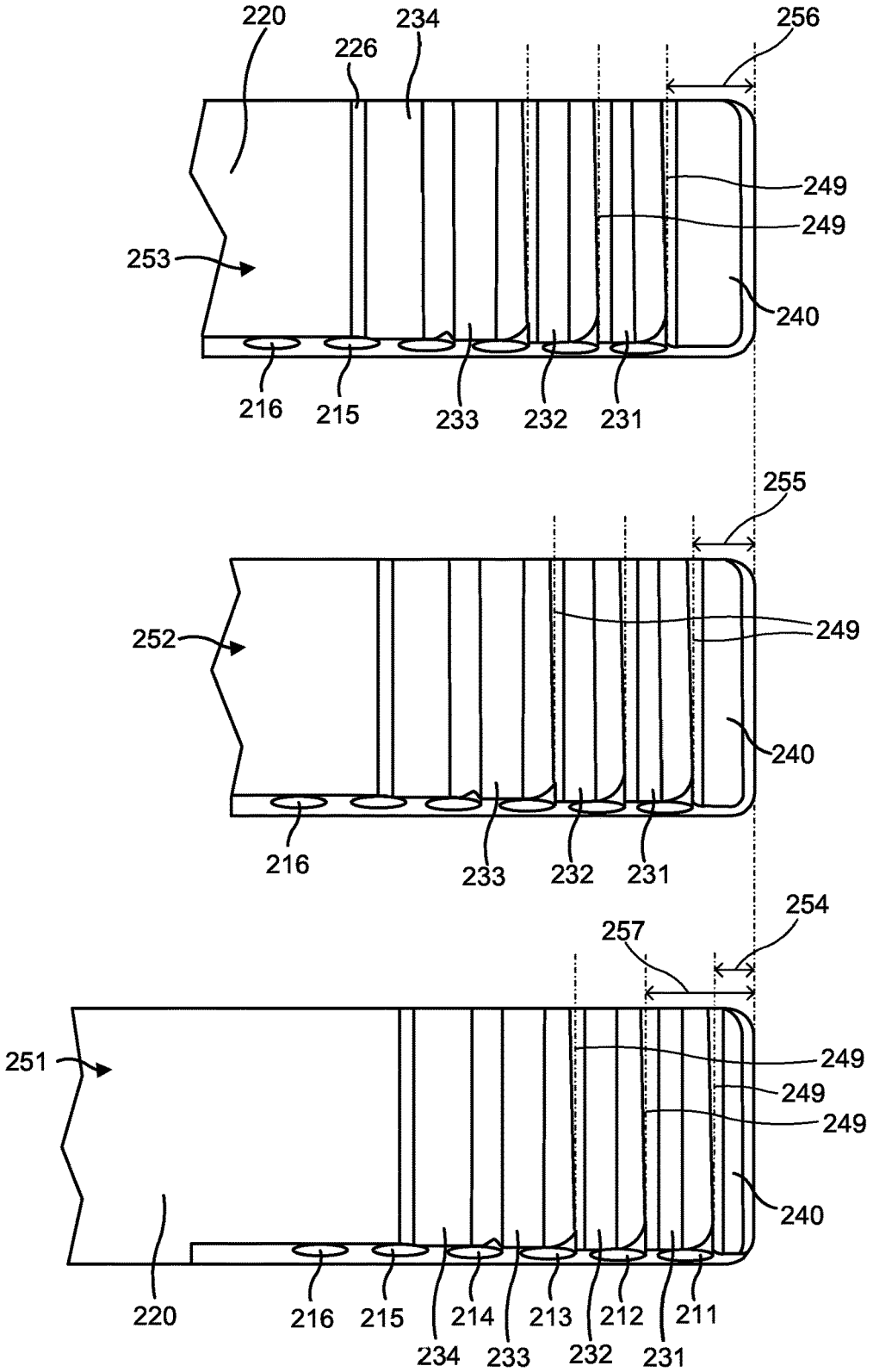
FIG. 13 is a radial view onto the lower cutting portions of three cutter blocks.

FIG. 13 shows the lower cutting portions of the three cutter blocks of the reamer. The ends 202 of the blocks are aligned axially as indicated by a chain-dotted line. The block shown in FIGS. 8 to 11 is block 251 at the bottom of the diagram. The lower cutting portions of the other two blocks are indicated at 252 and 253. These follow block 251 as the reamer is rotated and of course block 251 follows block 253. The axial positions of the cutters 211-216 relative to each other as described above with reference to FIGS. 8 to 10 for block 251, is reproduced on blocks 252 and 253. However, the axial distances to the end of the blocks differs from one block to another. Moreover, since the blocks are aligned and move in unison, the axial distances to the end of the tool, or any other reference point on the tool, likewise differ from one block to another. As indicated by the arrows 254, 255, 256 the axial distances from the end of each block to the edge of cutter 211, and likewise the distances to the other cutters, increase in the order: block 251, block 252, block 253. However, the distance indicated by arrow 256 to the edge of cutter 211 of block 253 is not as great as the distance 257 to the edge of cutter 212 of block 251.

The radial positions of the cutters 211-213 relative to each other is the same on all three cutter blocks, but the cutters 211-213 on block 252 are positioned radially slightly further from the axis of the tool than the corresponding cutters of block 251. Similarly the cutters 211-213 of block 253 are positioned slightly further from the axis of the tool than the corresponding cutters 211-213 of block 252. Thus the cutters 211-213 and the support structure around them has a configuration in which both axial and radial positions are the same, relative to each other, on all three cutter blocks, but this configuration of cutters and associated support structure is positioned slightly differently both axially relative to the ends of the blocks and radially relative to the tool axis.

The cutters 214 on the blocks 251, 252 and 253 are at progressively increasing radial distances from the tool axis, but the increase in distance is smaller than in the case of the cutters 211-213. The support structure around blocks 214-216 is similar in shape and appearance on all three cutter blocks but the cutters 215 and 216 are all at the same radial distance from the tool axis.

The radial and axial positions of the cutters on the three cutter blocks are arranged so that when the blocks are expanded the radial extremities of the cutters lie on an imaginary helix which winds around the axis with progressively increasing radius until the full gauge radius is reached. The helix then continues at constant radius.

Figure 14:
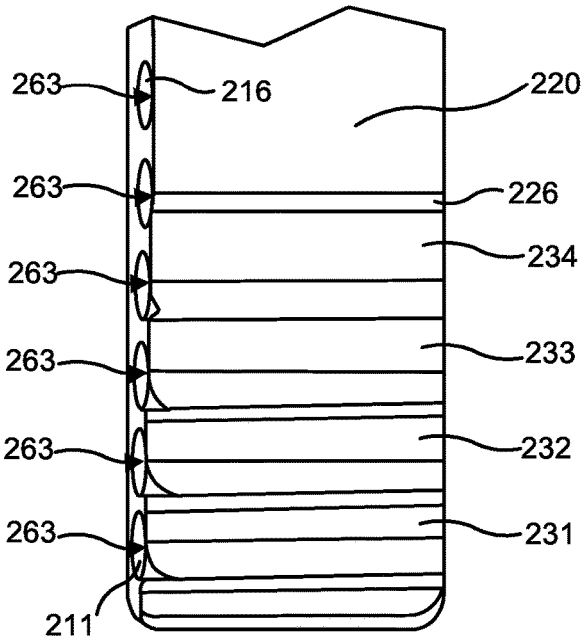
FIG. 14 is a radial view onto the lower cutting portion of a cutter block with the tool axis vertical.
Figure 15:
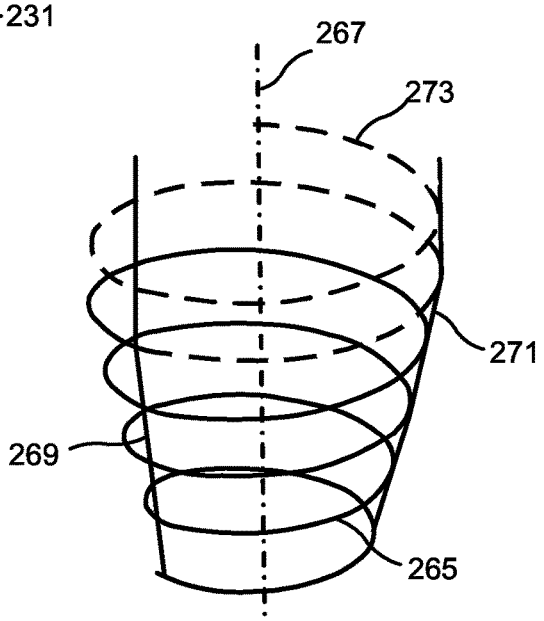
FIG. 15 diagrammatically illustrates positioning on a helix.

FIG. 14 shows the cutter block 251 with the tool axis vertical. The radially outer extremities of the cutters are indicated by the heads of arrows 263. FIG. 15 shows the path of the imaginary helix as a solid line 265. This helix has progressively increasing diameter as it winds upwards around axis 267. The block 251 is positioned so that (when expanded) the radial extremities 263 of its cutters 211-214 lie on the helix 265 at its intersections with vertical line 269. The block 252 is positioned so that the radial extremities of its cutters 211-214 are on the helix 265 at its intersections with vertical line 271, which is 120° around the axis from line 269. The block 253 is positioned so that the radial extremities of its cutters 211-214 also lie on the helix 265 at its intersections with a further vertical line (not shown) which is 120° around the axis from line 271 and so would be at the back of the helix as depicted in FIG. 15. The cutters 215, 216 at full gauge lie on a continuation of this helix at constant diameter, which is indicated in FIG. 15 as dashed helix 273.

Figure 16:
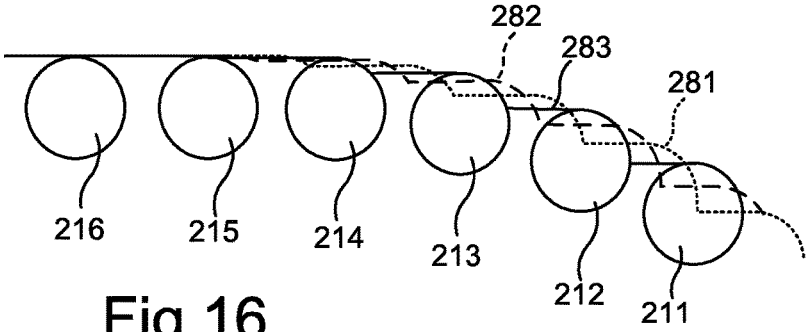
FIG. 16 diagrammatically shows the cutting outlines of three blocks, superimposed, with the tool axis horizontal.

FIG. 16 is a diagram in which the cutting outlines of the three blocks are shown superimposed. The outline of block 251 is shown as dotted line 281. The outline of the following block 252 is shown as dashed line 282 and it is displaced axially relative to outline 281 and so is axially further from the ends of the blocks (which would be at the right of FIG. 16). It is also radially outwards from the outline 281. The outline 283 of the next following block 253 is axially even further from the ends 202 of the blocks and is even further radially outwards.

With this arrangement, the cutter nearest to the end of the blocks and likewise nearest the end of the tool is cutter 211 of block 251. The axial order of the cutters on the three blocks is

| | |
|---|---|
| 1 | Cutter 211 of block 251 |
| 2 | Cutter 211 of block 252 |
| 3 | Cutter 211 of block 253 |
| 4 | Cutter 212 of block 251 |
| 5 | Cutter 212 of block 252 |
| 6 | Cutter 212 of block 253 |
| 7 | Cutter 213 of block 251 |

and so on up to cutter 216 of block 253. The radial distances from the tool axis increase in the same order, up to cutter 215 of the block 251. The outer extremity of this cutter is at full gauge and the remaining two cutters 215 and the cutters 216 on all three blocks are at the same full gauge radius. Because the cutters 211 to 214 on the lower cutting portions of the blocks are at progressively increasing radii, they all cut into the rock as the tool rotates.

Referring again to FIG. 11, it can be seen that the portions of the outer face of the block between surfaces 231-234 have zones, such as indicated at 288 between the chain lines 248, which face in a generally axial direction and so face towards formation rock which is to be cut away as the reamer advances axially. Facing in a generally axial direction may be defined as meaning that a line normal (i.e. perpendicular) to the surface is at an angle of no more than 45° to the tool axis. In order that contact between these zones and the rock does not prevent axial advance of the reamer, these zones are configured so that their circumferential extent does not run exactly orthogonal to the reamer axis.

Figure 12:
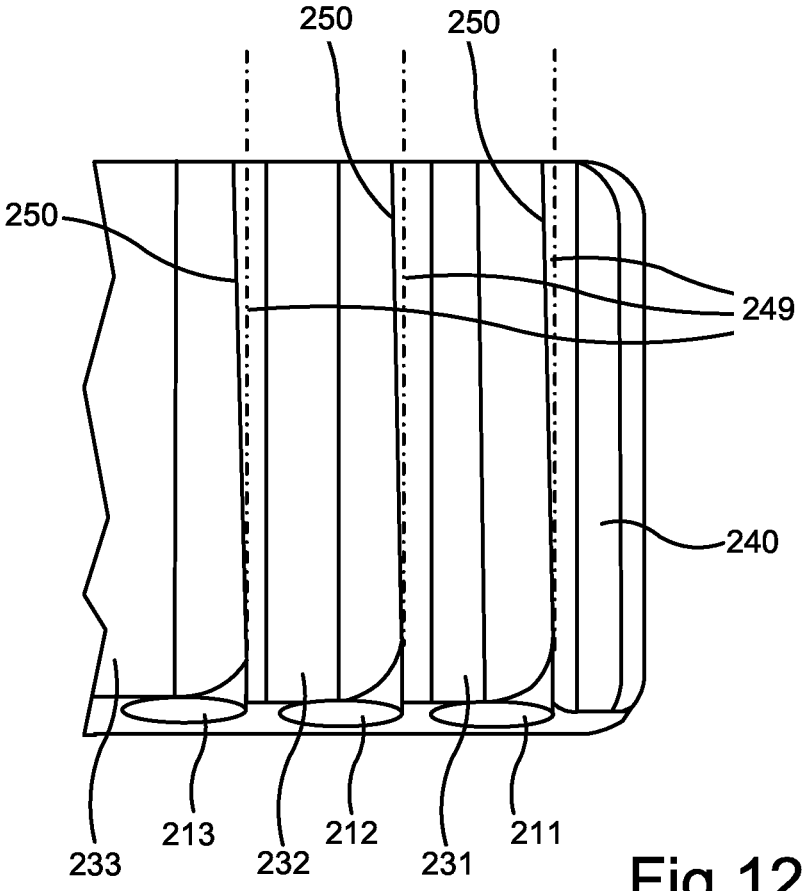
FIG. 12 is an enlarged radial view onto the end portion of a cutter block in the direction of arrow R in FIG. 9.

This is shown by the view in FIG. 12, looking radially inwards as indicated by arrow R in FIG. 9, onto the cutter block 251 of FIGS. 8 to 11. Directions orthogonal to the axis of the reamer are shown by notional lines 249. The lines 250 aligned with edges of cutters 211-213 in FIG. 12 are the inflection where curvature through arc 242 changes to curvature through arc 244. The portions of outer surface which face generally axially are shaped to taper away from the end of the cutter block (and also the end of the reamer) as they extend circumferentially around the tool axis, back from the leading faces of the cutters. Thus the lines 250 are at an angle to the orthogonal direction indicated by the lines 249.

The angles between lines 250 and 249 are arranged so that the axially facing zones of the blocks' outer faces lie approximately on a helix around the reamer axis which is similar to the helix 265. As the reamer rotates, the axially facing zones contact the newly cut rock but because they are positioned on a helix, rather than being orthogonal to the axis, they do not prevent axial advance of the reamer even though they do impose some control of the rate of advance.

The inventors have found that the controlled rate of advance can be approximately the same as the rate of uncontrolled advance achieved with a conventional reamer construction. For example a reamer with an expanded diameter of 150 mm may have angle of slightly less than 1 degree between the lines 250 and 249 and advance by 6 mm in each revolution. The axial spacing between the cutters may then be approximately equal to this distance of 6 mm. A reamer may have a diameter larger than 150 mm, for instance up to 600 mm or even more with the same designed rate of advance of 6 mm.

Figure 17:
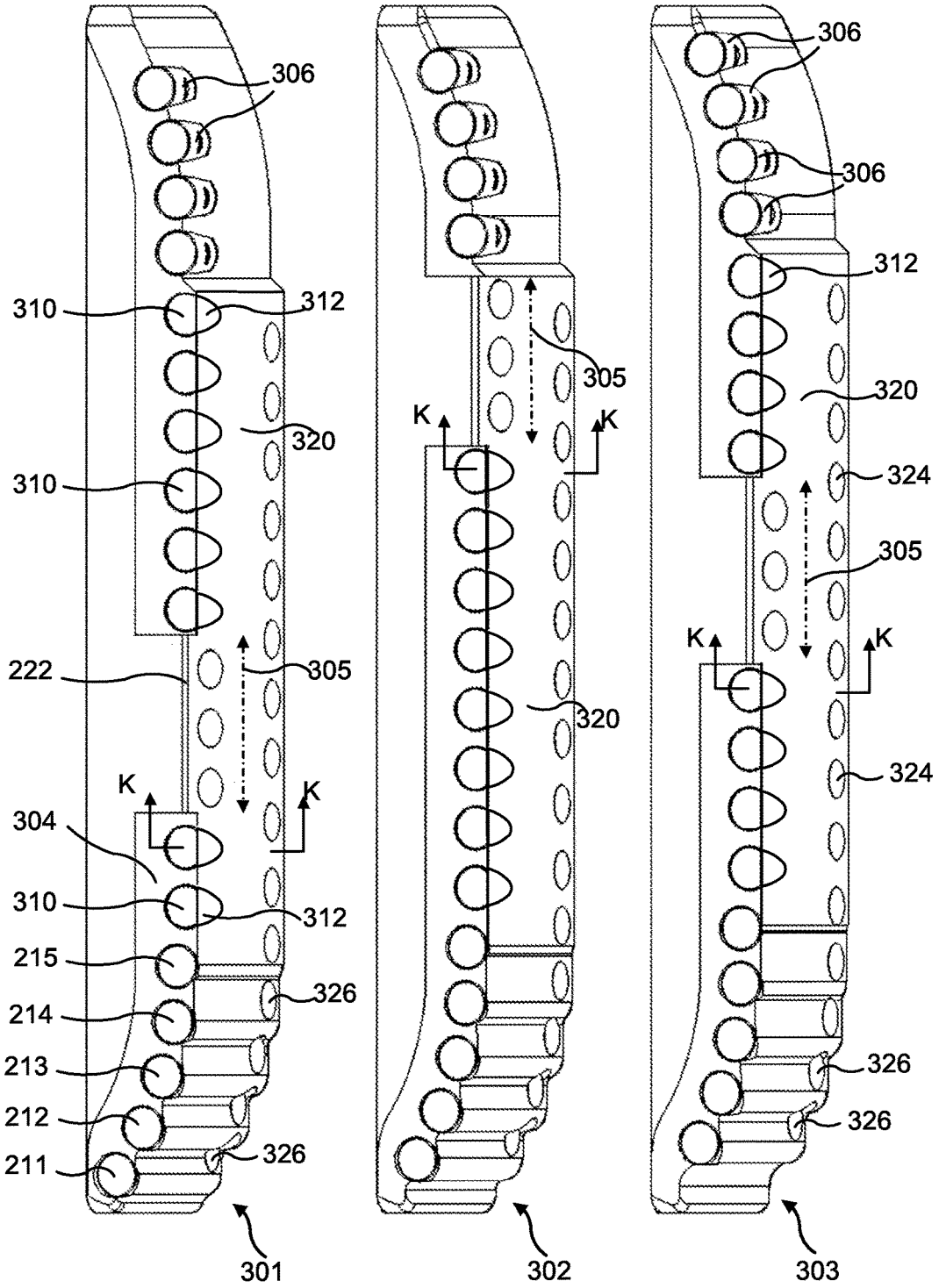
FIG. 17 shows the outer parts of three cutter blocks in three-quarter view.
Figure 18:
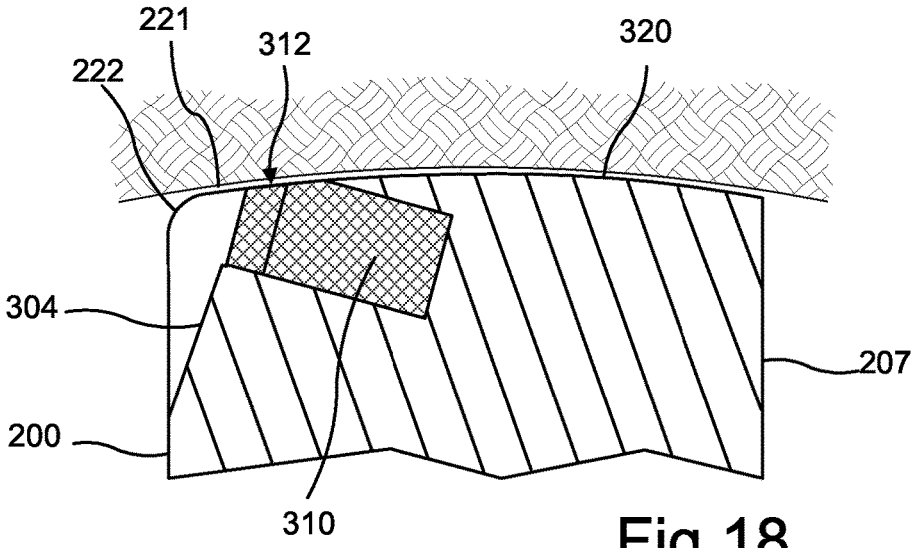
FIG. 18 is a section on line K-K of any of the three cutter blocks of FIG. 17.

FIG. 17 shows the whole of the outer parts of the three cutter blocks of another reamer. These use a number of features already shown by FIGS. 8-13 and the same reference numerals are used where appropriate. There are also some differences. As before the general structure of the reamer and the mechanism which expands it are as shown by FIGS. 2, 3 and 4. FIG. 18 shows a section, which could be on any of the lines K-K of FIG. 17.

The blocks 301, 302, 303 have cutters 211-215 at their lower cutting portions as in FIGS. 8 to 13. At the upper cutting portion, which is used to enlarge a borehole when pulling up on a drill string, there are a group of cutters 306 mounted conventionally, similarly to those in upper cutting portion 160 of FIG. 4.

A middle section between these two ends has an outer surface 320 which is a part-cylindrical surface at full gauge. Within this middle section, each block includes a length 305 without cutters which is a full gauge stabilising pad. As in FIG. 8, within the lengths 305 which are the stabilising pads, the outer surface 320 has a leading region 221 which extends to a curved leading edge 222 which is ahead, in the direction of rotation, of the leading surfaces of the cutters.

As disclosed in copending GB patent application GB2520998A, these lengths 305 which provide stabilising pads are at different axial positions on the blocks in order to provide stabilisation without preventing expansion of the reamer. As the reamer is expanded, each stabilising pad presses on the borehole wall. The pads cannot cut into the wall but the other two cutter blocks have cutters at the corresponding axial position and these do cut into the wall. This arrangement avoids placing three stabilising pads at the same axial position on the reamer, which does prevent expansion.

The remainder of each middle section of each block is provided with a row of cutters which are embedded so that their faces are exposed in a slanted area 304 and their radial extremities are aligned with the outer surface 320. However, these cutters are made with a truncated cylindrical shape and are secured to the support structure such that, as seen in FIG. 17, their extremities are an area 312 which is flush with surface 320. It will be appreciated that the cutters on each block form a single sequence of cutters distributed axially along the block with each cutter alongside another.

As can be seen from the drawing, the cutters in the lower cutting portions of blocks 302, 303 are positioned axially further from the end of the block than the corresponding cutters on block 301.

Near the trailing edge of surface 320, each block has a row of hard inserts 324 which are set flush with the surface 320 and are harder than the surface 320 of the steel outer part of the block, so as to resist wear. These hard inserts may be made of tungsten carbide particles sintered with a binder. There are also hard inserts 326 embedded to be flush with surfaces 231-234.

Figure 19:
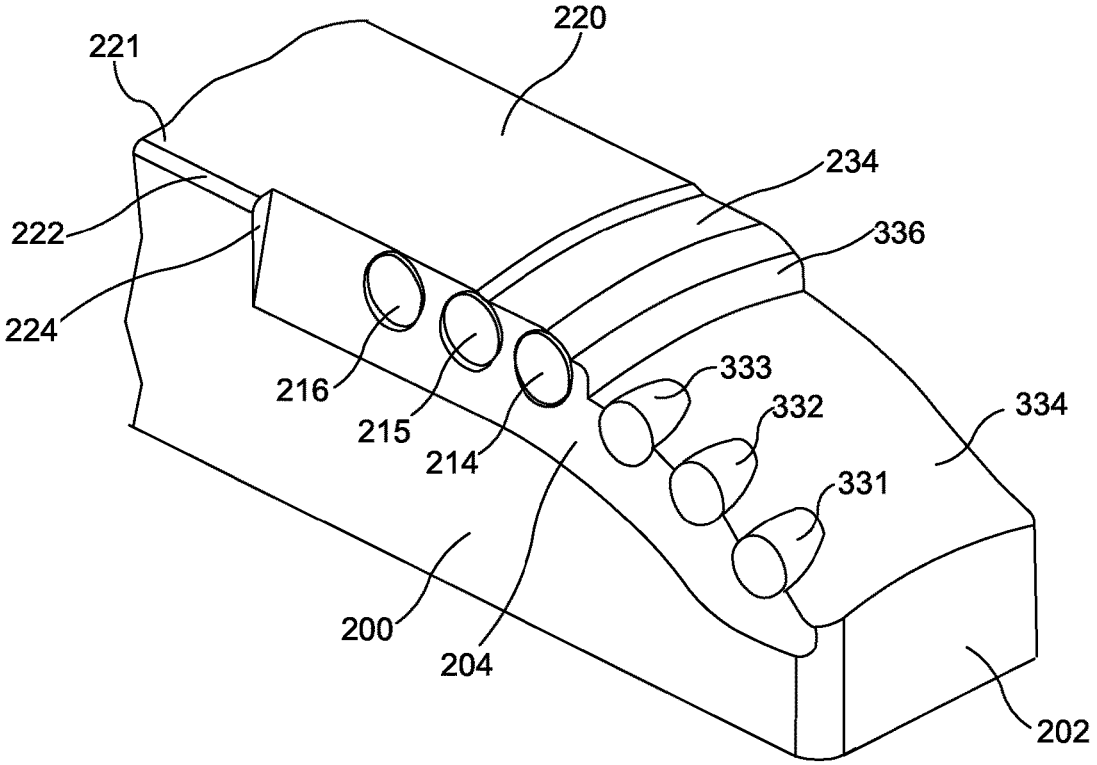
FIG. 19 is an isometric drawing showing a modification to the block of FIG. 8.

FIG. 19 shows a possible variation on the arrangement of FIGS. 8-11. The first cutter block of a reamer has leading face 200, slanted area 204, stabilising pad in the length 205, and embedded cutters 214, 215 and 216 all as for block 251 shown by FIG. 8. However, in place of the cutters 211-213 there are three cutters 331-333 which are embedded in conventional manner so as to project outwardly beyond the surface 334 of the support structure around them. The axial and radial positions of the cutters 331-333 are the same as for cutters 211-213 of block 251. The second and third blocks (not shown) of the reamer have similar appearance and have their cutters 331-333 and 214-216 in the same positions as cutters 211-216 on blocks 252 and 253. To allow axial advance of a reamer with these cutter blocks, the zone 336 which faces generally axially is oriented to taper back from a direction orthogonal to the axis in a manner similar to that described with reference to FIG. 12.

Figure 20:
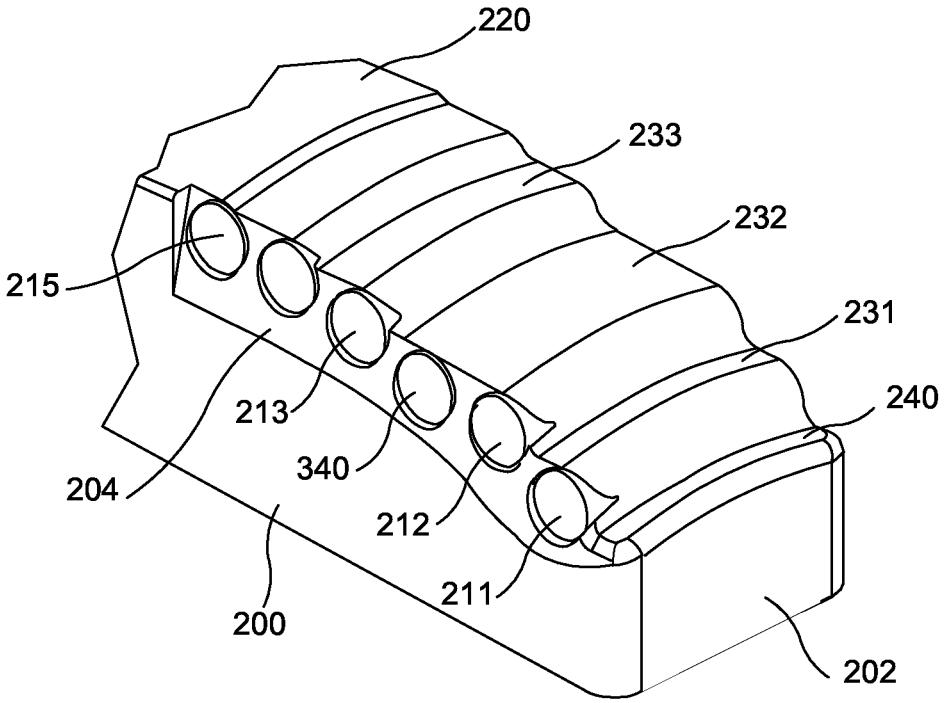
FIG. 20 is an isometric drawing showing further modifications to the block of FIG. 8.

FIG. 20 shows another possible variation. Again the lower cutting portion of a cutter block has a number of features similar to those of block 251 of FIGS. 8-11. However, the axial distance between cutters 212 and 213 is increased, compared to FIG. 8, so that the secondary gauge surface 232 has a larger axial extent and an additional cutter 340 is included in the sequence of cutters. This cutter 340 is at the same radial distance from the tool axis as cutter 212. Of course this increases the overall axial length of the tool. This cutter block thus has a sequence of axially spaced cutters 211, 212, 340 and 213-216. The radial distance from the tool axis increases progressively along the sequence but this progressive increase is not uniform because there is neither increase nor decrease of radial distance between cutters 212 and 340.

Modifications to the embodiments illustrated and described above are possible, and features shown in the drawings may be used separately or in any combination. The arrangements of stabilising pads and cutters could also be used in a reamer which does not expand and instead has cutter blocks at a fixed distance from the reamer axis. Other mechanisms for expanding a reamer are known and may be used. Cutters may be embedded or partially embedded in supporting structure. They may be secured by brazing or in other ways. The hard faces of the cutters will of course need to be exposed so that they can cut rock, but the radially inner part of a cylindrical cutter's hard face may possibly be covered or hidden by a part of the support structure so that the hard face is only partially exposed.

The invention claimed is:

1. A reaming tool for enlarging an underground borehole, comprising:

a tool body having a longitudinal axis therethrough; and at least three cutter assemblies coupled to the tool body and distributed azimuthally around the longitudinal axis of the tool body, the at least three cutter assemblies being radially expandable relative to the tool body and the longitudinal axis, wherein:

a first cutter assembly of the at least three cutter assemblies includes a first supporting structure having a length along the longitudinal axis between uphole and downhole ends of the first supporting structure, the first cutter assembly bearing a first sequence of cutters which are distributed along the length of the first supporting structure, cutters of the first sequence of cutters having hard surfaces facing in a direction of rotation of the tool about the longitudinal axis;

a second cutter assembly of the at least three cutter assemblies includes a second supporting structure having a length along the longitudinal axis between uphole and downhole ends of the second supporting structure, the second cutter assembly bearing a second sequence of cutters which are distributed along the length of the second supporting structure, cutters of the second sequence of cutters having hard surfaces facing in the direction of rotation of the tool;

a third cutter assembly of the at least three cutter assemblies includes a third supporting structure having a length along the longitudinal axis between uphole and downhole ends of the third supporting structure, the third cutter assembly bearing a third sequence of cutters which are distributed along the length of the third supporting structure, cutters of the third sequence of cutters having hard surfaces facing in the direction of rotation of the tool;

the cutters of the first sequence of cutters are spaced along the length of the first supporting structure and relative to each other with a spacing equal to spacing between the cutters of the second sequence relative to each other along the second supporting structure, and spacing between the cutters of the third sequence relative to each other along the third supporting structure, except that a distance from the first sequence of cutters to the downhole end of the first supporting structure, a distance from the second sequence of cutters to the downhole end of the second supporting structure, and a distance from the third sequence of cutters to the downhole end of the third supporting structure are each different; and an outer face of each of the first, second, and third support structures includes surfaces at the same radial distance from the longitudinal axis as extremities of cutters in the respective first, second, and third sequences of cutters, where cutters in each of the first, second, and third sequences of cutters are at different radial distances from the longitudinal axis.

2. The reaming tool of claim 1 wherein cutters in each of the first, second, and third sequences of cutters are positioned at radial distances from the longitudinal axis which progressively increase as the distance from a downhole end of the tool body increases.

3. The reaming tool of claim 2 wherein the cutters in each of the first, second, and third sequences of cutters lie on an imaginary helix of progressively increasing radius encircling the longitudinal axis of the tool body when the at least three cutter assemblies are in an expanded position.

4. The reaming tool of claim 3 the imaginary helix having spacing of between 3 mm and 10 mm between adjacent turns.

5. The reaming tool of claim 1 wherein each of the first, second, and third cutter assemblies further comprises a stabilising pad with an outward facing surface.

6. The reaming tool of claim 1 wherein:

at least two cutters in the first sequence of cutters are at a same radial position relative to each other and the longitudinal axis;

at least two cutters in the second sequence of cutters are at a same radial position relative to each other and the longitudinal axis, but at a different radial position and distance from a downhole end of the tool body relative to the at least two cutters in the first sequence of cutters; and at least two cutters in the third sequence of cutters are at a same radial position relative to each other and the longitudinal axis, but at a different radial position and distance from the downhole end of the tool body relative to the at least two cutters in the first sequence of cutters and the at least two cutters in the second sequence of cutters.

7. The reaming tool of claim 5, wherein the stabilising pad on each of the first, second, and third cutter assemblies is uphole of the respective first, second, or third sequence of cutters.

8. The reaming tool of claim 1, wherein:

the first, second, and third sequences of cutters, the cutters of the second sequence of are positioned at greater distances from a downhole end of the tool body and greater radial distances from the longitudinal axis than corresponding cutters in the first sequence of cutters so as to be offset axially along the longitudinal axis and radially from the longitudinal axis relative to cutters of the first sequence of cutters; and the cutters of the third sequence of positioned at greater distances from the downhole end of the tool body and greater radial distances from the longitudinal axis than corresponding cutters in the first and second sequences of cutters so as to be offset axially along the longitudinal axis and radially from the longitudinal axis relative to cutters of both the first and second sequences of cutters;

whereby the cutters of the first, second, and third sequences of cutters are at radial distances from the longitudinal axis which increase as axial distance from the end of the tool body increases.

9. The reaming tool of claim 8 wherein corresponding points of cutters in the first, second, and third sequences of cutters lie on an imaginary helix of progressively increasing radius encircling the longitudinal axis of the tool body when the at least three cutter assemblies are in an expanded position.

10. The reaming tool of claim 9 wherein there is a spacing of between 3 mm and 10 mm between adjacent turns of the imaginary helix.

11. The reaming tool of claim 1 wherein the only cutters on the first, second, and third cutter assemblies are the first, second, and third sequences of cutters.

12. The reaming tool of claim 1 wherein an outer surface of each cutter assembly of the at least three cutter assemblies includes at least one zone surface which follows the leading faces of one or more cutters on the cutter assembly, extends across a width of the cutter assembly, transitions between secondary stabilizing surfaces on the cutter assembly, faces towards an end of the cutter assembly, and is positioned at a distance from a downhole end of the tool body which increases as the zone surface extends circumferentially back from the leading faces of the one or more cutters.

13. The reaming tool of claim 1 wherein each of the at least three cutter assemblies is expandable by moving the entire cutter assembly radially outwards from the longitudinal axis.

14. A method of enlarging a borehole by rotating a reaming tool as defined in claim 1 in the borehole and advancing the tool in the borehole.

* * * * *